US010014665B2

(12) United States Patent
Kita et al.

(10) Patent No.: US 10,014,665 B2
(45) Date of Patent: Jul. 3, 2018

(54) SPARK PLUG

(71) Applicant: NGK SPARK PLUG CO., LTD., Nagoya-shi, Aichi (JP)

(72) Inventors: Jumpei Kita, Nagoya (JP); Haruki Yoshida, Tajimi (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 327 days.

(21) Appl. No.: 14/856,777

(22) Filed: Sep. 17, 2015

(65) Prior Publication Data

US 2016/0087410 A1 Mar. 24, 2016

(30) Foreign Application Priority Data

Sep. 24, 2014 (JP) ..... 2014-193680

(51) Int. Cl.
*H01T 13/04* (2006.01)
*H01T 13/20* (2006.01)
*H01T 13/34* (2006.01)

(52) U.S. Cl.
CPC ..... *H01T 13/04* (2013.01); *H01T 13/20* (2013.01); *H01T 13/34* (2013.01)

(58) Field of Classification Search
CPC ..... H01T 13/04; H01T 13/20; H01T 13/34
See application file for complete search history.

(56) References Cited

U.S. PATENT DOCUMENTS

| | | | | |
|---|---|---|---|---|
| 7,234,429 | B2 | 6/2007 | Abe et al. | 123/169 |
| 8,975,809 | B2 | 3/2015 | Nakamura | 313/143 |
| 2003/0117052 | A1 | 6/2003 | Yamaguchi et al. | 313/118 |
| 2006/0042610 | A1 | 3/2006 | Abe et al. | 123/635 |
| 2012/0126683 | A1* | 5/2012 | Yoshida | H01T 13/41 313/141 |
| 2014/0346945 | A1 | 11/2014 | Nakamura | 313/141 |
| 2015/0061485 | A1 | 3/2015 | Yoshida et al. | 313/135 |

FOREIGN PATENT DOCUMENTS

| | | | | |
|---|---|---|---|---|
| EP | 1309052 | A2 | 5/2003 | H01T 13/34 |
| JP | 2006-100250 | A | 4/2006 | F02P 13/00 |
| JP | 2013-041753 | A | 2/2013 | H01T 13/20 |
| JP | 2013-131375 | A | 7/2013 | F02P 13/00 |
| JP | 2013-206740 | A | 10/2013 | H01T 13/20 |

OTHER PUBLICATIONS

Search report issued in corresponding European Patent Application No. 15186698.5, dated Jan. 20, 2016.
Office Action received in corresponding Japanese Patent Application No. 2014-193680, dated Aug. 16, 2016.

* cited by examiner

*Primary Examiner* — Nimeshkumar Patel
*Assistant Examiner* — Jacob B Stern
(74) *Attorney, Agent, or Firm* — Kusner & Jaffe

(57) ABSTRACT

A spark plug having an insulator that includes a first portion which accommodates a front end of the metallic terminal. A portion of the metallic terminal has a roughened surface portion with a Vickers hardness of 200 Hv or greater and 320 Hv or smaller. A first ratio of an outside diameter of the roughened surface corresponding to at least a part of the first portion of the insulator to the first bore diameter of the insulator is 0.90 or greater. A second ratio of the first bore diameter to the second bore diameter of the insulator is 0.80 or greater and 0.98 or smaller.

4 Claims, 3 Drawing Sheets

SPARK PLUG

RELATED APPLICATIONS

This application is a claims the benefit of Japanese Patent Application No. 2014-193680, filed Sep. 24, 2014.

FIELD OF THE INVENTION

The present invention relates to a spark plug.

BACKGROUND OF THE INVENTION

Conventionally, spark plugs are used in an internal combustion engine. Such spark plugs typically have an insulator having a through hole, a center electrode which is disposed at a front end side of the through hole, a metallic terminal which is disposed at a rear end side of the through hole and a connecting portion which connects electrically the center electrode and the metallic terminal in the through hole.

In fabricating a spark plug, a metallic terminal is inserted into a through hole so as to press a material (for example, a material containing glass) for a connecting portion which is disposed within the through hole in an insulator. If an excessive force is transmitted to the insulator through the metallic terminal, there is a possibility that the insulator may break. Additionally, in the event that the material for the connecting portion is not pressed sufficiently, the durability (for example, loaded life properties) of the connecting portion may be reduced.

A main advantage of the invention is to reduce the possibility of breakage of the insulator by suppressing the reduction in durability of the connecting portion.

The invention has been made with a view to solving at least part of the problem described above and can be realized as an application example which will be described below.

SUMMARY OF THE INVENTION

Application Example 1

According to a first aspect of the present invention, there is provided a spark plug including:

a rod-shaped center electrode which extends in the direction of an axis;

an insulator having a through hole which extends from a front end side to a rear end side in the direction of the axis and in which at least a portion of the center electrode is disposed in a front end side portion of the through hole;

a metallic terminal at least a portion of which is disposed in a rear end side portion of the through hole and a rear end side portion of which is exposed out of the through hole; and a connecting portion which connects electrically the center electrode to the metallic terminal in the through hole; wherein the insulator includes:

- a first portion which accommodates a front end of the metallic terminal and which has a first bore diameter of 2.9 mm or smaller;
- a second portion which is disposed closer to the rear end side than the first portion and which has a second bore diameter which is greater than the first bore diameter; and
- a middle portion which is disposed between the first portion and the second portion and a bore diameter of which increases towards the rear end side, wherein the metallic terminal includes a roughened surface portion formed at a position of the metallic terminal which corresponds to at least a part of the first portion, at least a part of the second portion and the middle portion of the insulator in the direction of the axis when the metallic terminal is inserted into the thorough hole in the insulator, the roughened surface having at least one of one or more projecting portions and one or more recess portions on an outer circumferential surface thereof, wherein a Vickers hardness of a portion of the metallic terminal which is disposed in the through hole and is disposed closer to the rear end side than the roughened surface portion is 200 Hv or greater and 320 Hv or smaller, wherein a first ratio which is a ratio of an outside diameter of the roughened surface corresponding to at least a part of the first portion of the insulator to the first bore diameter of the insulator is 0.90 or greater, and wherein a second ratio which is a ratio of the first bore diameter to the second bore diameter of the insulator is 0.80 or greater and 0.98 or smaller.

According to the configuration described above, the possibility of breakage of the insulator can be reduced while suppressing the reduction in durability of the connecting portion.

Application Example 2

According to a second aspect of the present invention, there is provided a spark plug according to the Application Example 1, wherein the second ratio is 0.80 or greater and 0.96 or smaller.

According to the configuration described above, the possibility of breakage of the insulator can be reduced further.

Application Example 3

According to a third aspect of the present invention, there is provided a spark plug according to the Application Example 1 or 2, wherein a maximum outside diameter of the second portion of the insulator is 7.8 mm or smaller, and wherein a ratio of the second bore diameter of the second portion to the maximum outside diameter of the second portion is 0.45 or smaller.

According to the configuration described above, even though the maximum outside diameter of the second portion of the insulator is a small value of 7.8 mm or smaller, the reduction in durability of the connecting portion can be suppressed.

Application Example 4

According to a fourth aspect of the present invention, there is provided a spark plug according to any one of the Application Examples 1 to 3, wherein at least a portion of a front end side surface of the exposed portion of the metallic terminal which is exposed out of the through hole is in contact with a rear end face of the insulator, and wherein when the rear end face of the insulator and the front end side surface of the exposed portion of the metallic insulator are projected along the direction of the axis on to a plane which is at right angles to the axis, a ratio of a projection area of the front end side surface of the exposed portion of the metallic terminal to a projection area of the rear end face of the insulator is 0.65 or greater.

According to the configuration described above, the force from the metallic terminal can be dispersed on the rear end face of the insulator when the metallic terminal is inserted into the through hole in the insulator, and therefore, the possibility of breakage of the insulator can be reduced.

The invention can be realized in various forms. The invention can be realized, for example, in the form of a spark plug and an internal combustion engine in which the spark plug is mounted.

DETAILED DESCRIPTION OF THE PREFERRED EMBODIMENTS

A. First Embodiment

Figure 1:
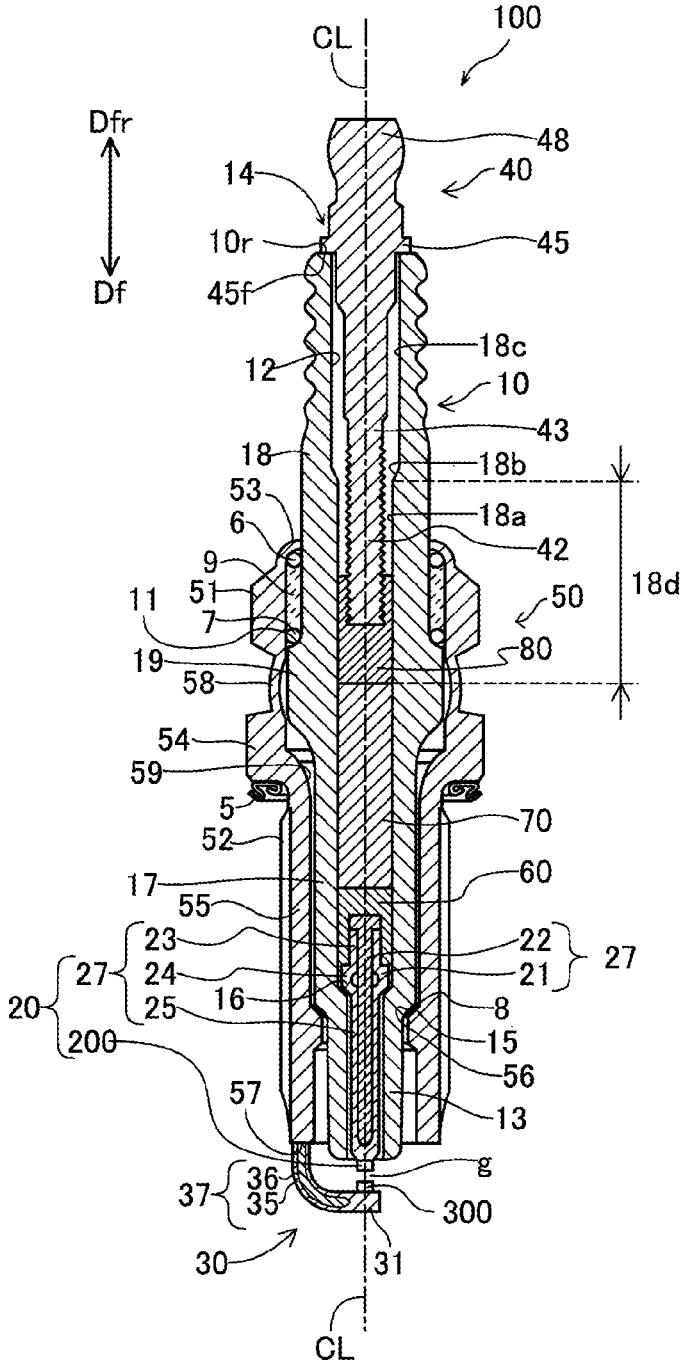
FIG. 1 is a sectional view of an embodiment of a spark plug.

FIG. 1 is a sectional view of an embodiment of a spark plug. In the figure, a center line CL (also, referred to as an axis CL) of a spark plug 100 is shown. The section shown includes the center line CL. Hereinafter, a direction parallel to the center line CL will be referred to as the "direction of the center line CL" or simply as an "axial direction." A radial direction of a circle which is centered at the center line CL will be referred to simply as a "radial direction," and the direction of a circumference of the circle centered at the center line CL will also be referred to as a "circumferential direction." In the direction parallel to the center line CL, a downward direction in FIG. 1 will also be referred to as a front end direction Df, and an upward direction will also be referred to as a rear end direction Dfr. The front end direction Df is directed from a metallic terminal 40, which will be described later, to electrodes 20, 30. Additionally, a side oriented in the front end direction Df in FIG. 1 will be referred to as a front end side of the spark plug 100, and a side oriented in the rear end direction Dfr in FIG. 1 will be referred to as a rear end side of the spark plug 100.

The spark plug 100 has an insulator 10 (also, referred to as a "ceramic insulator 10"), a center electrode 20, a ground electrode 30, a metallic terminal 40, a metal shell 50, a first seal portion 60 which is conductive, a resistor element 70, a second seal portion 80 which is conductive, a front end side packing 8, talc 9, a first rear end side packing 6, and a second rear end side packing 7.

The insulator 10 is a substantially cylindrical member having a through hole 12 (hereinafter, also referred to as an "axial hole 12") which extends along the center line CL to penetrate the insulator 10. The insulator 10 is formed of calcined alumina (other insulating materials can also be adopted). The insulator 10 has a nose portion 13, a first reduced outside diameter portion 15, a front end side body portion 17, a collar portion 19, a second reduced outside diameter portion 11, and a rear end side body portion 18, which are aligned sequentially in that order from the front end side in the rear end direction Dfr. An outside diameter of the first reduced outside diameter portion 15 gradually decreases from the rear side towards the front end side. A first reduced bore diameter portion 16 is formed near the first reduced outside diameter portion 15 (in the example shown in FIG. 1, at the front end side body portion 17) of the insulator 10, and a bore diameter of the first bore diameter portion 16 is formed so as to decrease from the rear end side towards the front end side. An outside diameter of the second reduced outside diameter portion 11 gradually decreases from the front end side towards the rear end side.

Figure 2:
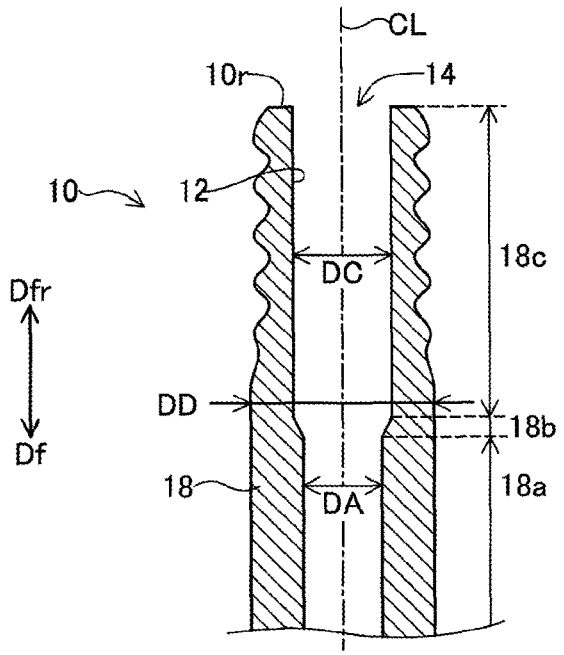
FIG. 2 is an enlarged sectional view of a rear-end side portion of an insulator 10.

FIG. 2 is a partially enlarged sectional view of a rear end side portion of the insulator 10. The rear end side portion of the insulator 10 is divided according to bore diameters into a first portion 18*a*, a second portion 18*c* which is disposed closer to the rear end side than the first portion 18*a* and a middle portion 18*b* which is disposed between these portions 18*a*, 18*c*. In the figure, a first bore diameter DA is a bore diameter of the first portion 18*a*. An end of the first portion 18*a* which is oriented in the front end direction Df is connected to the first reduced bore diameter portion 16 (FIG. 1). In FIG. 2, a second bore diameter DC is a bore diameter of the second portion 18*c*. The second bore diameter DC is greater than the first bore diameter DA. A maximum outside diameter DD is a maximum outside diameter of the second portion 18*c*. A maximum outside diameter DD is greater than the second bore diameter DC. The middle portion 18*b* connects the first portion 18*a* and the second portion 18*c*. A bore diameter of the middle portion 18*b* gradually increases towards the rear end side. In the insulator 10, the second portion 18*c* is disposed closer to the rear end side than the middle portion 18*b* and forms a rear end face 10*r* of the insulator 10.

As shown in FIG. 1, the center electrode 20 is inserted into a front end side of the axial hole 12 in the insulator 10. The center electrode 20 has a rod-shaped shaft portion 27 which extends along the center line CL and a first tip 200 which is joined to a front end of the shaft portion 27. The shaft portion 27 has a nose portion 25, a collar portion 24 and a head portion 23 which are aligned sequentially in that order from the front end side towards the rear end side in the rear end direction Dfr. The first tip 200 is joined to a front end of the nose portion 25 (that is, the front end of the shaft portion 27) (through, for example, laser welding). At least a portion of the first tip 200 is exposed out of the axial hole 12 at the front end side of the insulator 10. A surface of the collar portion 24 which is oriented in the front end direction Df is supported by the first reduced bore diameter portion 16 of the insulator 10. Additionally, the shaft portion 27 has an outer layer 21 and a core portion 22. The outer layer 21 is formed of a material having superior resistance to oxidation to that of a material for the core portion 22, that is, a material which wears less even when exposed to combustion gases within a combustion chamber of an internal combustion engine (for example, pure nickel, and an alloy of nickel and chrome). The core portion 22 is formed of a material having higher heat conductivity than that of the material for the outer layer 21 (for example, pure copper and a copper alloy). A rear end portion of the core portion 22 is exposed out of the outer layer 21 and forms a rear end portion of the center electrode 20. The other portion of the core portion 22 is covered by the outer layer 21. However, the whole of the core portion 22 may be covered by the outer layer 21. Additionally, the first tip 200 is formed by the use of a material which has superior durability against electrical discharge to that of the material for the shaft portion 27 (for example, noble metal such as iridium (Ir) and platinum (Pt), tungsten (W) or an alloy which contains at least one selected from these metals).

Figure 3:
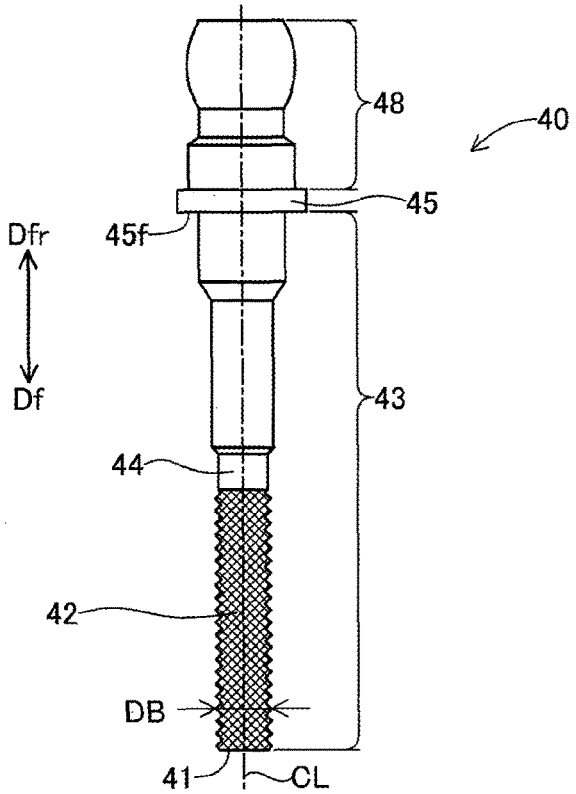
FIG. 3 is a schematic external view of a metallic terminal 40.

A portion of the metallic terminal 40 is inserted into a rear end side of the axial hole 12 of the insulator 10. FIG. 3 is a schematic view showing an external appearance of the metallic terminal 40. The metallic terminal 40 is formed by the use of a conductive material (for example, a metal such as carbon steel). The metallic terminal 40 has a collar portion 45, a mounting portion 48 which is disposed closer to the rear end side than the collar portion 45 and a leg portion 43 which is disposed closer to the front end side than the collar portion 45. An outer circumferential surface of a portion 42 of the leg portion 43 is knurled (referred to as a "roughened surface portion 42"). In the embodiment shown in FIG. 3, the roughened surface portion 42 is a portion of the leg portion 43 which includes a front end 41.

As shown in FIG. 1, the collar portion 45 and the mounting portion 48 are exposed out of the through hole 12. A plug cap (not shown), to which a high-tension cable is connected, is mounted on the mounting portion 48. The leg portion 43 is disposed in the through hole 12. The roughened surface portion 42 is formed at a position of the leg portion 43 which corresponds to at least a part of the first portion 18*a*, at least a part of the second portion 18*c* and the middle portion 18*b* of the insulator 10 when the metallic terminal 40 is inserted into the through hole 12. A maximum outside diameter DB in FIG. 3 is a maximum diameter of a portion of the roughened surface portion 42 which is accommodated in the first portion 18*a* (FIG. 1). The surface 45*f* of the collar portion 45 (FIGS. 1, 3) which faces the front end direction Df is in contact with the rear end face 10*r* of the insulator 10 (FIGS. 1, 2).

Figure 4:
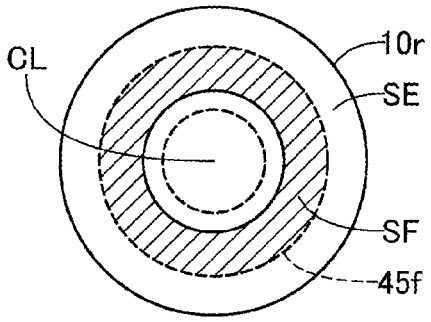
FIG. 4 is a projection diagram of a rear end face 10*r* of the insulator 10 and a surface 45*f* of a collar portion 45 of metallic terminal 40.

FIG. 4 is a projection which is obtained by projecting the rear end face 10*r* of the insulator 10 and the surface 45*f* of the collar portion 45 of the metallic terminal 40 which faces the front end direction Df along the direction of the axis CL on to a plane which is at right angles to the axis CL. In the figure, outlines of a projected area of the rear end face 10*r* of the insulator 10 (that is, an outer circumferential outline and an inner circumferential outline) are indicted by solid lines. Additionally, outlines of a projected area of the surface 45*f* of the metallic terminal 40 (that is, an outer circumferential outline and an inner circumferential outline) are indicated by broken lines. A first area SE is an area of the projected area of the rear end face 10*r* of the insulator 10. A second area SF is an area of a portion (a hatched portion in the figure) of the projected area of the rear end face 10*r* of the insulator 10 which overlaps the projected area of the surface 45*f* of the metallic terminal 40. In the event that the projected area of the surface 45*f* of the metallic terminal 40 is greater than the projected area of the rear end face 10*r* of the insulator 10, that is, the projected area of the rear end face 10*r* of the insulator 10 is included in the projected area of the surface 45*f* of the metallic terminal 40, the second area SF is equal to the first area SE.

The surface 45*f* of the metallic terminal 40 can be said to be an end face, facing the front end side in the front end direction Df, of a portion of the metallic terminal 40 which is exposed out of the through hole 12 (here, the whole of the collar portion 45 and the mounting portion 48). The surface 45*f* of the exposed portion which faces the front end side in the front end direction Df can be brought into contact with the rear end face 10*r* of the insulator 10 when a portion (here, the leg portion 43) of the metallic terminal 40 is inserted into the through hole 12. It is noted that a portion which connects to the portion (here, the leg portion 43) which is inserted into the through hole 12 is excluded from the surface 45*f*. The second area SF is an area of a portion of the projected area of the rear end face 10*r* of the insulator 10 which overlaps the projected area of the surface 45*f* of the exposed portion of the metallic terminal 40 which faces the front end side in the front end direction Df. In this embodiment, both the rear end face 10*r* of the insulator 10 and the surface 45*f* of the metallic terminal 40 constitute planes which are at right angles to the center line CL.

As shown in FIG. 1, in the axial hole 12 in the insulator 10, the resistor element 70 having a substantially cylindrical shape is disposed between the metallic terminal 40 and the center electrode 20 to suppress electrical noise. The resistor element 70 is formed by the use of a material which contains, for example, a conductive material (for example, carbon particles), ceramic particles (for example, $ZrO_2$) and glass particles (for example, glass particles of an Si—$O_2$—$B_2O_3$—$Li_2O$—BaO system). The first seal portion 60 which is conductive is disposed between the resistor element 70 and the center electrode 20, and the second seal portion 80 which is conductive is disposed between the resistor element 70 and the metallic terminal 40. A front end portion of the metallic terminal 40 (here, a portion of the roughened surface portion 42 which faces the front end side in the front end direction DO is embedded in the second seal portion 80. Since irregularities are formed on a circumferential surface of the roughened surface portion 42, a contact area of the roughened surface portion 42 with the second seal portion 80 is increased. Consequently, the joint between the second seal portion 80 and the metallic terminal 40 can be strengthened. The seal portions 60, 80 are formed by the use of a material which includes the same glass particles as those contained in the material for the resistor element 70 and metallic particles (for example, Cu) as a conductive material. The center electrode 20 and the metallic terminal 40 are connected electrically via the resistor element 70 and the seal portions 60, 80. In this way, the whole of the resistor element 70 and the seal portions 60, 80 constitutes an example of a connecting portion which connects electrically the center electrode 20 and the metallic terminal 40 in the through hole 12.

The second seal portion 80 is disposed in the first portion 18*a*. Consequently, the first bore diameter DA (FIG. 2) of the first portion 18*a* is also referred to as a "seal diameter DA." In this embodiment, to ease the fabrication of the spark plug 100, the first portion 18*a* is configured so that its bore diameter gradually decreases towards the front end side in the front end direction Df. Here, as the first bore diameter DA, a bore diameter of a portion of the first portion 18*a* (FIG. 1) which faces the rear end side in the rear end direction Dfr is adopted. Specifically, a bore diameter of a portion where to accommodate at least one of the metallic terminal 40 and the seal portion (here, the second seal portion 80) which is in contact with the metallic terminal 40 (referred to as a "rear end side portion 18*d*") is adopted as the first bore diameter DA. A difference between a maximum value and a minimum value of the bore diameter at the rear end side portion 18*d* is smaller than 0.1 mm. Consequently, at the rear end side portion 18*d*, the bore diameter remains constant with an accuracy of ±0.1 mm. This bore diameter is adopted as the first bore diameter DA. The shape of the first portion 18*a* is not limited to the tapered one and hence may be a cylindrical shape with a constant bore diameter.

The metal shell 50 is a substantially cylindrical member having a through hole 59 which extends along the center line CL to penetrate the metal shell 50. The metal shell 50 is formed by the use of a low carbon steel material (other conductive materials (for example, metallic materials) can also be adopted). The insulator 10 is inserted into the through hole 59 in the metal shell 50. The metal shell 50 is fixed to an outer circumference of the insulator 10. A front end of the insulator (in this embodiment, a front end side portion of the nose portion 13) is exposed out of the through hole 59 at a front end side of the metal shell 50. A rear end of the insulator 10 (in this embodiment, a rear end side portion of the rear end side body portion 18) is exposed out of the through hole 59 at a rear end side of the metal shell 50.

The metal shell 50 has a body portion 55, a seat portion 54, a deformable portion 58, a tool engagement portion 51, and a crimping portion 53 which are aligned sequentially in this order from the front end side towards the rear end side. The seat portion 54 is a collar-like portion. The body portion 55 is a substantially cylindrical portion which extends from the seat portion 54 along the center line CL in the front end direction Df. Threads 52 are formed on an outer circumferential surface of the body portion 55 so as to be threaded into a mounting hole of the internal combustion engine. An annular gasket 5, which is formed by bending a sheet of metal, is fitted in between the seat portion 54 and the threads 52.

The metal shell 50 has a reduced bore diameter portion 56 which is disposed closer to the rear end side in the rear end direction Dfr than the deformable portion 58. A bore diameter of the reduced bore diameter portion 56 gradually decreases from the rear end side towards the front end side. The front end side packing 8 is held between the reduced bore diameter portion 56 of the metal shell 50 and the first reduced outside diameter portion 15 of the insulator 10. The front end side packing 8 is an O-shaped iron ring (other materials (for example, a metallic material such as copper) can also be adopted).

The tool engagement portion 51 is a portion where a tool (for example a spark plug wrench) for tightening the spark plug 100 is brought into engagement. In this embodiment, the tool engagement portion 51 has a substantially hexagonal prism-like external shape which extends along the center line CL. The crimping portion 53 is disposed closer to the rear end side than the second reduced diameter portion 11 of the insulator 10 to thereby constitute a rear end (that is, an rear end in the rear end direction Dfr) of the metal shell 50. The crimping portion 53 is bent towards radially inwards. On the front end side of the crimping portion 53, the first rear end side packing 6, the talc 9 and the second rear end side packing 7 are disposed sequentially in this order towards the front end side in the front end direction Df between an inner circumferential surface of the metal shell 50 and an outer circumferential surface of the insulator 10. In this embodiment, these rear end side packings 6, 7 are C-shaped iron rings (other materials can also be adopted).

In fabricating the spark plug 100, the crimping portion 53 is crimped so as to be bent inwards. Then, the crimping portion 53 is pressed towards the front end side in the front end direction Df. This deforms the deformable portion 58, whereby the insulator 10 is pressed towards the front end side via the packings 6, 7 and the talc 9 in the metal shell 50. The front end side packing 8 is pressed between the first reduced outside diameter portion 15 and the reduced bore diameter portion 56 to thereby seal a gap between the metal shell 50 and the insulator 10. Thus, the metal shell 50 is fixed to the insulator 10.

In this embodiment, the ground electrode 30 has a rod-shaped shaft portion 37 and a second tip 300 which is joined to a distal end portion 31 of the shaft portion 37. A rear end of the shaft portion 37 is joined to a front end face 57 of the metal shell 50 (that is, a front end side surface 57 in the front end direction DO (through resistance welding, for example). The shaft portion 37 extends from the front end face 57 of the metal shell 50 in the front end direction Df and is bent towards the center line CL to reach the front end portion 31. The distal end portion 31 is disposed on a side of the center electrode 20 which faces the front end side in the front end direction Df. The second tip 300 is joined to a surface of surfaces of the distal end portion 31 which faces the center electrode 20 (through laser welding, for example). The second tip 300 is formed by the use of a material which has superior durability against electrical discharge to that of the material for the shaft portion 37 (for example, noble metal such as iridium (Ir) and platinum (Pt), tungsten (W) or an alloy which contains at least one selected from these metals). The first tip 200 of the center electrode 20 and the second tip 300 of the ground electrode 30 form a gap g to create a spark.

The shaft portion 37 of the ground electrode 30 has an outer layer 35 which forms at least a portion of the surface of the shaft portion 37 and a core portion 36 which is embedded in the outer layer 35. The outer layer 35 is formed of a material having superior resistance to oxidation (for example, an alloy which contains pure nickel and chrome). The core portion 36 is formed of a material having higher heat conductivity than that of the material for the outer layer 35 (for example, pure copper).

An arbitrary fabricating method can be adopted as a fabricating method of the spark plug 100 configured in the way described above. For example, the following fabricating method can be adopted. Firstly, an insulator 10, a center electrode 20, a metallic terminal 40, a metal shell 50, and a rod-shaped ground electrode 30 are fabricated by the known methods. Additionally, a powder material for seal portions 60, 80 and a powder material for a resistor element 70 are prepared.

Next, the center electrode 20 is inserted into a through hole 12 in the insulator 10 from a rear end side opening 14 in the rear end direction Dfr. As has been described in relation to FIG. 1, the center electrode 20 is supported by a first reduced bore diameter portion 16 formed on the insulator 10 to thereby be disposed in a predetermined position in the through hole 12.

Next, the powder materials for the first seal portion 60, the resistor element 70 and the second seal portion 80 are poured and molded sequentially in the order of the members 60, 70 and 80. The powder materials are poured from the opening 14 of the through hole 12. The powder materials so poured are molded into shapes which are substantially similar to those of the corresponding members 60, 70, 80 sequentially by the use of a rod inserted from the opening 14.

Next, the powder materials are heated to a predetermined temperature which is higher than a softening point of the glass constituent contained in the powder materials. With the powder materials heated to the predetermined temperature, a leg portion 43 of the metallic terminal 40 is inserted from the opening 14 of the through hole 12 into the through hole 12. As a result of this, the individual powder materials are compressed and sintered into the seal portions 60, 80 and the resistor element 70. The metallic terminal 40 is disposed so that a surface 45*f* of the metallic terminal 40 which faces the front end side in the front end direction Df is positioned so as to be in contact with a rear end face 10*r* of the insulator 10.

Since the second bore diameter DC of the second portion 18*c* which forms the opening 14 in the insulator 10 is greater than the first bore diameter DA of the first portion 18*a*, the insertion of the leg portion 43 is eased. Additionally, since the first bore diameter DA of the first portion 18*a* where a front end 41 of the leg portion 43 is accommodated is smaller than the second bore diameter DC of the second portion 18*c*, it is possible to suppress the material for the second seal portion 80 from moving in the rear end direction Dfr in a gap between an inner circumferential surface of the through hole 12 and an outer circumferential surface of the leg portion 43. As a result of this, the material for the seal portions 60, 80 and the material for the resistor element 70 can be compressed as required through the metallic terminal 40. The leg portion 43 can be deformed in compressing the material for the seal portions 60, 80 and the material for the resistor element 70. For example, a portion lying further rearwards in the rear end direction Dfr than the roughened surface portion 42, that is, a portion 44 having a smallest outside diameter of the remaining portion of the leg portion 43 excluding the roughened surface portion 42 may be bent.

Next, the metal shell 50 is assembled to the outer circumference of the insulator 10, and the ground electrode 30 fixed to the metal shell 50. Next, the ground electrode 30 is bent, whereupon a spark plug is completed.

B. Evaluation Tests

The loaded life properties, possibility of failure of the front end portion of the insulator 10 and possibility of failure of the rear end portion of the insulator 10 were evaluated by using sample spark plugs. Table 1 below shows the results of the evaluation test carried out.

tion 42, second bore diameter DC, maximum outside diameter DD of second portion 18*c*, configuration of roughened surface portion 42, first ratio R1 (DB/DA), second ratio R2 (DA/DC), third ratio R3 (DC/DD), fourth ratio R4 (SF/SE), and Vickers hardness V. In this evaluation test, 31 samples which are numbered from 1 to 31 were evaluated.

The configuration of the roughened surface portion 42 is selected from two types of configurations of a configuration A and a configuration B. In the configuration A, as shown in FIG. 1, the roughened surface portion 42 extends from a position inside the first portion 18*a* to a position inside the second portion 18*c* after passing the middle portion 18*b*. In the configuration B, although not illustrated, the roughened surface portion 42 is formed only in a portion of the leg portion 43 of the metallic terminal 40 which is disposed in the first portion 18*a*. The configuration B was realized by knurling the portion of the leg portion 43 which is disposed in the first portion 18*a*.

The Vickers hardness V denotes a Vickers hardness of the leg portion 43 of the metallic terminal 40. The samples were measured for Vickers hardness V according to the following procedure. Firstly, the metallic terminal 40 was cut on a plane which includes the center line of the metallic terminal

TABLE 1

| No. | First Bore Diameter DA (mm) | Roughened Surface Portion Outside Diameter DB (mm) | Second Bore Diameter DC (mm) | Body Portion Outside diameter DD (mm) | Roughened Surface Portion Configuration | R1 (DB/DA) | R2 (DA/DC) | R3 (DC/DD) | R4 (SF/SE) | Vickers Hardness V | Loaded Life Properties | Insulator Front End Portion Failure | Insulator Rear End Portion Failure | Total |
|---|---|---|---|---|---|---|---|---|---|---|---|---|---|---|
| 1 | 2.7 | 2.43 | 3.10 | 7.5 | A | 0.90 | 0.87 | 0.41 | 0.67 | 300 | 10 | 10 | 10 | 30 |
| 2 | 2.7 | 2.40 | 3.10 | 7.5 | A | 0.89 | 0.87 | 0.41 | 0.67 | 300 | 3 | 10 | 10 | 23 |
| 3 | 2.7 | 2.43 | 3.10 | 6.7 | A | 0.90 | 0.87 | 0.46 | 0.67 | 300 | 10 | 10 | 3 | 23 |
| 4 | 2.7 | 2.43 | 3.10 | 6.9 | A | 0.90 | 0.87 | 0.45 | 0.67 | 300 | 10 | 10 | 10 | 30 |
| 5 | 2.7 | 2.60 | 3.90 | 7.5 | A | 0.96 | 0.69 | 0.52 | 0.67 | 300 | 3 | 10 | 3 | 16 |
| 6 | 2.7 | 2.60 | 3.50 | 7.5 | A | 0.96 | 0.77 | 0.47 | 0.67 | 300 | 5 | 10 | 5 | 20 |
| 7 | 2.7 | 2.60 | 3.38 | 7.5 | A | 0.96 | 0.80 | 0.45 | 0.67 | 300 | 10 | 10 | 10 | 30 |
| 8 | 2.7 | 2.60 | 3.10 | 7.5 | A | 0.96 | 0.87 | 0.41 | 0.67 | 300 | 10 | 10 | 10 | 30 |
| 9 | 2.7 | 2.60 | 2.81 | 7.5 | A | 0.96 | 0.96 | 0.38 | 0.67 | 300 | 10 | 10 | 10 | 30 |
| 10 | 2.7 | 2.60 | 2.76 | 7.5 | A | 0.96 | 0.98 | 0.37 | 0.67 | 300 | 10 | 7 | 10 | 27 |
| 11 | 2.7 | 2.60 | 2.70 | 7.5 | A | 0.96 | 1.00 | 0.36 | 0.67 | 300 | 10 | 3 | 10 | 23 |
| 12 | 2.7 | 2.57 | 3.10 | 7.5 | A | 0.95 | 0.87 | 0.41 | 0.67 | 300 | 10 | 10 | 10 | 30 |
| 13 | 2.7 | 2.54 | 3.10 | 7.5 | A | 0.94 | 0.87 | 0.41 | 0.67 | 300 | 10 | 8 | 10 | 28 |
| 14 | 3.0 | 2.88 | 3.90 | 9.0 | B | 0.96 | 0.77 | 0.43 | 0.50 | 300 | 10 | 10 | 10 | 30 |
| 15 | 3.0 | 2.88 | 3.45 | 9.0 | B | 0.96 | 0.87 | 0.38 | 0.50 | 300 | 10 | 10 | 10 | 30 |
| 16 | 2.9 | 2.78 | 3.77 | 7.5 | A | 0.96 | 0.77 | 0.50 | 0.67 | 300 | 5 | 10 | 5 | 20 |
| 17 | 2.9 | 2.78 | 3.33 | 7.5 | A | 0.96 | 0.87 | 0.44 | 0.67 | 300 | 10 | 10 | 10 | 30 |
| 18 | 2.7 | 2.60 | 3.10 | 7.5 | A | 0.96 | 0.87 | 0.41 | 0.67 | 150 | 3 | 10 | 10 | 23 |
| 19 | 2.7 | 2.60 | 3.10 | 7.5 | A | 0.96 | 0.87 | 0.41 | 0.67 | 190 | 5 | 10 | 10 | 25 |
| 20 | 2.7 | 2.60 | 3.10 | 7.5 | A | 0.96 | 0.87 | 0.41 | 0.67 | 200 | 10 | 10 | 10 | 30 |
| 21 | 2.7 | 2.60 | 3.10 | 7.5 | A | 0.96 | 0.87 | 0.41 | 0.67 | 320 | 10 | 10 | 10 | 30 |
| 22 | 2.7 | 2.60 | 3.10 | 7.5 | A | 0.96 | 0.87 | 0.41 | 0.67 | 350 | 10 | 3 | 10 | 23 |
| 23 | 2.9 | 2.60 | 3.16 | 7.9 | A | 0.90 | 0.92 | 0.40 | 0.67 | 300 | 3 | 10 | 10 | 23 |
| 24 | 2.9 | 2.60 | 3.56 | 7.9 | A | 0.90 | 0.82 | 0.45 | 0.67 | 300 | 3 | 10 | 10 | 23 |
| 25 | 2.9 | 2.60 | 3.63 | 7.9 | A | 0.90 | 0.80 | 0.46 | 0.67 | 300 | 3 | 10 | 10 | 23 |
| 26 | 2.9 | 2.60 | 3.12 | 7.8 | A | 0.90 | 0.93 | 0.40 | 0.67 | 300 | 5 | 10 | 10 | 25 |
| 27 | 2.9 | 2.60 | 3.51 | 7.8 | A | 0.90 | 0.83 | 0.45 | 0.67 | 300 | 3 | 10 | 10 | 23 |
| 28 | 2.9 | 2.60 | 3.59 | 7.8 | A | 0.90 | 0.81 | 0.46 | 0.67 | 300 | 3 | 10 | 5 | 18 |
| 29 | 2.7 | 2.60 | 3.10 | 7.5 | A | 0.96 | 0.87 | 0.41 | 0.65 | 300 | 10 | 10 | 6 | 26 |
| 30 | 2.7 | 2.60 | 3.10 | 7.5 | A | 0.96 | 0.87 | 0.41 | 0.64 | 300 | 10 | 8 | 5 | 23 |
| 31 | 2.7 | 2.60 | 3.10 | 7.5 | B | 0.96 | 0.87 | 0.41 | 0.67 | 300 | 3 | 10 | 10 | 23 |

Table 1 shows relationships between specifications of samples taken and evaluation points given thereto in relation to loaded life properties, failure of front end portion of insulator and failure of rear end portion of insulator, and total values of the three evaluation points. The samples taken are numbered as shown in the table and are specified as shown by parameters in relation to first bore diameter DA, maximum outside diameter DB of roughened surface por-

40. Then, a Vickers hardness was measured on a cross section of a portion (here, the leg portion 43) of the metallic terminal 40 which was disposed in the through hole 12. The measuring position was the position of the center line of the metallic terminal 40 on the cross section of the portion having the smallest outside diameter (the portion 44 in the example shown in FIG. 3) and disposed closer to the rear end side in the rear end direction Dfr than the roughened surface portion 42. In the event that the metallic terminal 40 (particularly, the leg portion 43 which is disposed in the through hole 12) is bent, the metallic terminal 40 was cut so that a cross section near the measuring position includes the center line of the metallic terminal 40.

The evaluation point on the loaded life properties denotes an evaluation result resulting from a loaded life test. The loaded life test was carried out based on the test conditions prescribed under 7.14 of JIS B8031: 2006 (spark plug of internal combustion engine). Then, 10 samples having the same configuration were prepared for evaluating each of the samples numbered, and each sample was subjected to a test operation of 100 hours. In those ten samples, the number of samples whose rate of change of resistance value was 50% or smaller was adopted as an evaluation point. The resistance value is an electric resistance value between the metallic terminal 40 and the center electrode 20 and was measured according to the prescription under 7.13 of JIS B8031: 2006. The rate of change of resistance value is a ratio of difference between pre-test resistance value and post-test resistance value to the pre-test resistance value.

The evaluation point of the failure of the front end portion of the insulator denotes the evaluation of a possibility of failure in fabricating a spark plug. Specifically speaking, 1000 samples were fabricated, and the number of samples was counted in which a front end side portion (here, any one of the leg portion 13, the first reduced outside diameter portion 15 and the front end side body portion 17) of the insulator 10 failed as a result of inserting the metallic terminal 40 into the through hole 12 in the insulator 10. The front end side portion of the insulator 10 could fail by means of a force transmitted thereto from the metallic terminal 40 through the materials for the members 60, 70, 80 and at least a portion of the center electrode 20. The evaluation point was determined according to the number of failed samples (referred to as a first failure number) in the 1000 samples. A correlation between the first failure number and the evaluation point is as follows.

first failure number=0: 10 points
1≤first failure number≤2: 7 points
3≤first failure number≤5: 5 points
6≤first failure number: 3 points The evaluation point of the failure of the rear end portion of the insulator denotes the evaluation of a possibility of failure in fabricating a spark plug. Specifically speaking, 1000 samples were fabricated, and the number of samples was counted in which a rear end side portion (here, the rear end side body portion 18) of the insulator 10 failed as a result of inserting the metallic terminal 40 into the through hole 12 in the insulator 10. The rear end side portion (here, the portion near the rear end face 10*r*) of the insulator 10 could fail by means of a force transmitted thereto from the metallic terminal 40 as a result of the contact with the metallic terminal 40. The evaluation point was determined according to the number of failed samples (referred to as a second failure number) in the 1000 samples. A correlation between the second failure number and the evaluation point is as follows.

second failure number=0: 10 points
1≤second failure number≤2: 7 points
3≤second failure number≤5: 5 points
6≤second failure number: 3 points B1. As to Vickers Hardness V Five samples from the $18^{th}$ sample to the $22^{nd}$ sample are different from one another in Vickers hardness V and are similar in the other parameters or configurations. The Vickers hardness V was adjusted by adjusting the ratio of carbon contained in the carbon steel which is the material for the metallic terminal 40. As shown in Table 1, the loaded life properties with high Vickers hardness V (10 points (V=200, 320, 350(Hv))) are better than the loaded life properties with low Vickers hardness V (3 points (V=150 Hv), 5 points (V=190 Hv).

The reason is assumed as follows. As has been described above, in fabricating the spark plug, the materials for the seal portions 60, 80 and the material for the resistor element 70 are compressed by the insertion of the metallic terminal 40. Here, in case the materials are not compressed sufficiently, voids could be formed in the members 60, 70, 80. Since it is difficult for electric current to flow through voids, in case there are formed a number of voids, conductive paths in these members 60, 70, 80 are limited to limited areas where no void is formed. As a result, the loaded life properties could be reduced. In the event that the Vickers hardness V of the leg portion 43 of the metallic terminal 40 is high, the likelihood that the metallic terminal 40 (in particular, the leg portion 43) is deformed when the metallic terminal 40 is inserted is suppressed. Consequently, the materials of the seal portions 60, 80 and the material of the resistor element 70 can be compressed appropriately by the insertion of the metallic terminal 40. As a result of this, the formation of voids in the members 60, 70, 80 is suppressed, whereby the loaded life properties are enhanced.

Additionally, as shown by the $18^{th}$ to $22^{nd}$ samples in Table 1, the evaluation point of the failure of the front end portion of the insulator with low Vickers hardness V (10 points (V=150, 190, 200, 320 (Hv))) is better than the evaluation point of the failure of the front end portion of the insulator with high Vickers hardness V (3 points (V=350 Hv). The reason is assumed as follows. With low Vickers hardness V, the metallic terminal 40 (in particular, the leg portion 43) tends to easily be deformed when the metallic terminal 40 is inserted. Consequently, the force applied to the insulator 10 from the metallic terminal 40 through the materials for the members 60, 70, 80 and the center electrode 20 is suppressed from becoming excessive. As a result, the failure of the front end side portion of the insulator 10 can be suppressed.

The Vickers hardnesses V at which the loaded life properties with the evaluation point of 10 and the failure of the front end portion of the insulator with the evaluation point of 10 could be realized are 200 Hv (the $20^{th}$ sample) and 320 Hv (the $21^{st}$ sample). One value selected arbitrarily from these values can be adopted as a lower limit of a preferable range (equal to or greater than a lower limit and equal to or smaller than an upper limit) of the Vickers hardness V. For example, a value of 200 Hv or greater may be adopted as a Vickers hardness V. Additionally, in these values, an arbitrary value equal to or greater than the lower limit may be adopted as an upper limit. For example, a value equal to or smaller than 320 Hv may be adopted as a Vickers hardness V.

Table 1 shows evaluation results of various samples whose Vickers hardnesses V fall in the preferable range described above (specifically, 300 Hv) and in which a value of at least one of the parameters DA, DB, DC, DD, R1, R2, R3 and R4 is different from the value of the corresponding parameter of the $18^{th}$ to $22^{nd}$ samples. As shown by these various samples, good loaded life properties (for example, the loaded life properties of 10 points) can be realized by applying the Vickers hardness V in the preferable range to the various samples having different values in relation to the parameters DA, DB, DC, DD, R1, R2, R3 and R4. In this way, it is assumed that the preferable range of the Vickers hardness V described above can be applied to the various spark plugs.

B2. As to First Ratio R1 (DB/DA)

As shown by the $1^{st}$ to $4^{th}$ samples, the $7^{th}$ to $10^{th}$ samples, the $12^{th}$ sample, the $13^{th}$ sample, the $17^{th}$ sample, the $20^{th}$ sample, the $21^{st}$ sample, the $29^{th}$ sample, the $30^{th}$ sample and the like, loaded life properties with great first ratios R1 (10 points (R1=0.90, 0.94, 0.95, 0.96) are better than loaded life properties with small first ratios R1 (3 points (R1=0.89)). The reason is that in the event that the first ratio R1 is great, a ratio of a radial size of a gap between the roughened surface portion 42 of the metallic terminal 40 and the first portion 18*a* of the through hole 12 to the maximum outside diameter DB is small, and therefore, the material for the second seal portion 80 is suppressed from moving to the rear end side in the rear end direction Drf through the gap. As a result, the materials for the members 60, 70, 80 can be compressed appropriately, and therefore, it is assumed that the loaded life properties are improved.

The first ratios R1 which could realize the loaded life properties of 10 points are 0.90 (the $1^{st}$, $3^{rd}$ and $4^{th}$ samples), 0.94 (the $13^{th}$ sample), 0.95 (the $12^{th}$ sample) and 0.96 (the $7^{th}$ to $10^{th}$ samples and the like). One value selected arbitrarily from these values can be adopted as a lower limit of a preferable range (equal to or greater than the lower limit and equal to or smaller than an upper limit) of the first ratio R1. For example, a value equal to or greater than 0.90 may be adopted as the first ratio R1. Additionally, in those values, the arbitrary value equal to or greater than the lower limit may be adopted as the upper limit. For example, a value equal to or smaller than 0.96 may be adopted as the first ratio R1. A value greater than 0.96 may be adopted as the upper limit of the first ratio R1. In this case, too, the materials for the members 60, 70, 80 can be compressed appropriately, and therefore, it is assumed that the loaded life properties are improved. It is noted that the first ratio R1 is preferably equal to or smaller than 0.99. According to this configuration, since the material for the second seal portion 80 can move through the gap between the roughened surface portion 42 of the metallic terminal 40 and the first portion 18*a* of the through hole 12, it is possible to suppress the force applied from the metallic terminal 40 to the insulator 10 through the materials for the members 60, 70, 80 and the center electrode 20 from becoming excessive. As a result, it is possible to suppress the failure of the front end side portion of the insulator 10.

As shown in Table 1, good loaded life properties (for example, the loaded life properties of 10 points) can be realized by applying the first ratio R1 in the preferable range to the various samples having different values in relation to the parameters DA, DB, DC, DD, R1, R2, R3 and R4. In this way, it is assumed that the preferable range of the first ratio R1 described above can be applied to the various spark plugs.

B.3 As to Second Ratio R2 (DA/DC)

Seven samples from the $5^{th}$ to $11^{th}$ sample have different second ratios R2. The second ratio R2 was adjusted by adjusting the second bore diameter DC. The other configurations are common to the seven samples. As shown in Table 1, loaded life properties with great second ratios R2 (10 points (R2=0.80, 0.87, 0.96, 0.98, 1.00) are better than loaded life properties with small second ratios R2 (3 points (R2=0.69), 5 points (R2=0.77). The reason is assumed as follows. In the event that the second ratio R2 is small, a ratio in diameter difference of the middle portion 18*b* (FIG. 2) to the second bore diameter DC is great. Consequently, when inserting the leg portion 43 of the metallic terminal 40 into the through hole 12, a smooth insertion could be interrupted as a result of the leg portion 43 being brought into contact with the middle portion 18*b*. As a result, the materials for the members 60, 70, 80 are not compressed sufficiently, whereby the loaded life properties could be reduced.

Additionally, as shown by the $5^{th}$ to $11^{th}$ samples in Table 1, evaluation points of the failure of the front end portion of the insulator with small second ratios R2 (7 points (R2=0.98), 10 points (R2=0.69, 0.70, 0.80, 0.87, 0.96)) are better than an evaluation point of the failure of the front end portion of the insulator with a great second ratio R2 (3 points (R2=1.00)). The reason is assumed as follows. In the event that the second ratio R2 is small, a ratio in diameter difference of the middle portion 18*b* (FIG. 2) to the second bore diameter DC is great. Consequently, when inserting the leg portion 43 of the metallic terminal 40 into the through hole 12, the momentum of the inserted leg portion 43 is mitigated as a result of the leg portion 43 being brought into contact with the middle portion 18*b*. This can suppress the force applied from the metallic terminal 40 to the insulator 10 through the materials for the members 60, 70, 80 and the center electrode 20 from becoming excessive. As a result, the failure of the front end side portion of the insulator 10 can be suppressed.

Additionally, as shown by the $5^{th}$ to $11^{th}$ samples in Table 1, evaluation points of the failure of the rear end portion of the insulator with great second ratios R2 (10 points (R2=0.80, 0.87, 0.96, 0.98, 1.00)) are better than evaluation points of the failure of the rear end portion of the insulator with small second ratios R2 (3 points (R2=0.69), 5 points (R2=0.77)). The reason is assumed as follows. In the event that the second ratio R2 is small, a ratio in diameter difference of the middle portion 18*b* (FIG. 2) to the second bore diameter DC is great. Consequently, when inserting the leg portion 43 of the metallic terminal 40 into the through hole 12, the orientation of the metallic terminal 40 relative to the center line of the insulator 10 could be changed as a result of the leg portion 43 being brought into contact with the middle portion 18*b*. Additionally, the leg portion 43 could be brought into contact with a portion of the insulator 10 which lies near the rear end face 10*r* (referred to as a rear end portion). In this way, in the event that the leg portion 43 is inserted into the through hole 12 in such a state that the leg portion 43 is in contact with the rear end portion of the insulator 10, the rear end portion of the insulator 10 could fail.

The second ratios R2 which could realize the loaded life properties with the evaluation point of 10, the failure of the front end portion of the insulator with the evaluation points of 7 or greater and the failure of the rear end portion of the insulator with the evaluation points of 10 are 0.80 (the $7^{th}$ sample), 0.87 (the $8^{th}$ sample), 0.96 (the $9^{th}$ sample), and 0.98 (the $10^{th}$ sample). One value selected arbitrarily from these four values can be adopted as a lower limit of a preferable range (equal to or greater than the lower limit and equal to or smaller than an upper limit) of the second ratio R2. For example, a value equal to or greater than 0.80 may be adopted as the second ratio R2. Additionally, in these four values, the arbitrary value equal to or greater than the lower limit may be adopted as the upper limit. For example, the value equal to or smaller than 0.98 may be adopted as the second ratio R2. In these four second ratios R2, the second ratios R2 which realized the failure of the front end portion of the insulator of 10 points were the remaining values excluding 0.98 given to the $10^{th}$ sample, that is, the values equal to or smaller than 0.96. Consequently, in case the value equal to or smaller than 0.96 is adopted as the second ratio R2, the failure of the front end side portion of the insulator 10 can be suppressed further.

As shown in Table 1, good loaded life properties (for example, the loaded life properties of 10 points), good failures of the front end portion of the insulator (for example, the failures of the front end portion of the insulator of 7 points or greater), and good failures of the rear end portion of the insulator (for example, the failures of the rear end portion of the insulator of 10 points) can be realized by applying the second ratio R2 in the preferable range to the various samples having different values in relation to the parameters DA, DB, DC, DD, R1, R2, R3 and R4. In this way, it is assumed that the preferable range of the second ratio R2 described above can be applied to the various spark plugs.

B4. As to Configuration of Roughened Surface Portion 42 and First Bore Diameter DA In the 31 samples, the samples having the roughened surface portion 42 of the configuration B were the $14^{th}$, $15^{th}$, and $31^{st}$ samples. In relation to the $14^{th}$ and $15^{th}$ samples, the first bore diameter DA is 3.0 mm, and the maximum outside diameter DB of the roughened surface portion 42 is 2.88. In relation to the $31^{st}$ sample, the first bore diameter DA is 2.7 mm, and the maximum outside diameter DB is 2.60 mm. The $14^{th}$ and $15^{th}$ samples have different second bore diameters DC. The $14^{th}$ sample has a second bore diameter DC of 3.90 mm, and the $15^{th}$ sample has a second bore diameter DC of 3.45 mm.

In the $31^{st}$ sample, compared with the $14^{th}$ and $15^{th}$ samples, the bore diameter DA of the through hole 12 and the outside diameter DB of the leg portion 43 are small, near the portion where the metallic terminal 40 contacts the second seal portion 80. Here, the $14^{th}$ and $15^{th}$ samples having the great first bore diameter DA and great maximum outside diameter DB both realize the loaded life properties of 10 points, the failure of the front end portion of the insulator of 10 points and the failure of the rear end portion of the insulator of 10 points. On the other hand, the $31^{st}$ sample having the small first bore diameter DA and small maximum outside diameter DB realizes loaded life properties of 3 points (although realizing a failure of the front end portion of the insulator of 10 points and a failure of the rear end portion of the insulator of 10 points). The reason that the loaded life properties of the $31^{st}$ sample are smaller than those of the $14^{th}$ and $15^{th}$ samples is assumed as follows. In the $31^{st}$ sample, since the maximum outside diameter DB of the leg portion 43 is small, the leg portion 43 tends to easily be deformed. Consequently, the materials for the members 60, 70, 80 are not compressed sufficiently, leading to a reduction in the loaded life properties. In general, since the maximum outside diameter DB is smaller than the first bore diameter DA, a small first bore diameter DA results in a small maximum outside diameter DB. Consequently, the loaded life properties tend to be small with a small first bore diameter DA.

Here, when comparing the $8^{th}$ sample with the $31^{st}$ sample, the $8^{th}$ and $31^{st}$ samples have roughened surface portions 42 which are configured differently, and the other configurations are common to the two samples. The roughened surface portion 42 of the $8^{th}$ sample has the configuration A. The roughened surface portion 42 of the $8^{th}$ sample extends from a position inside the first portion 18*a* to a position inside the second portion 18*c* through the middle portion 18*b*. The evaluation point of the loaded life properties of the $8^{th}$ sample is 10. In this way, although the first bore diameter DA is equal to the maximum outside diameter DB, the loaded life properties can be improved as a result of the roughened surface portion 42 extending from the position inside the first portion 18*a* to the position inside the second portion 18*c* through the middle portion 18*b*. The reason is assumed as follows. The roughened surface portion 42 is knurled to enhance the mechanical strength (for example, bending strength). The mechanical strength (for example, the bending strength) of the leg portion 43 is enhanced by the roughened surface portion 42 so treated extending from the first portion 18*a* to the second portion 18*c*. Consequently, the leg portion 43 is suppressed from being deformed when the leg portion 43 is inserted into the through hole 12. As a result, the materials for the members 60, 70, 80 are compressed appropriately to thereby enhance the loaded life properties.

As shown in Table 1, the preferable ranges of the parameters V, R1, R2 are all induced from the evaluation results of the samples having the first bore diameter DA of 2.9 mm or smaller and the roughened surface portion 42 having the configuration A. In this way, the good loaded life properties can be realized by adopting the configuration A for the configuration of the roughened surface portion 42 even in the event that the first bore diameter DA of 2.9 mm or smaller.

The first bore diameters DA which could realize the loaded life properties of 10 points are 2.7 and 2.9 (mm). The value arbitrarily selected from these two values can be adopted as a lower limit of a preferable range (equal to or greater than the lower limit and equal to or smaller than an upper limit) of the first bore diameter DA. For example, a value equal to or greater than 2.7 mm may be adopted as the first bore diameter DA. It is assumed that a smaller value (for example, 2.5 mm) can be adopted as the lower limit of the first bore diameter DA. In case a first bore diameter of 2.5 mm or greater is adopted, the deformation of the leg portion 43 can be suppressed, and it is assumed that a reduction in the loaded life properties can be suppressed.

B5. As to Maximum Outside Diameter DD and Third Ratio R3 (DC/DD)

In relation to three samples from the $23^{rd}$ to $25^{th}$ samples, the maximum outside diameter DD of the second portion 18*c* of the insulator 10 is 7.9 mm. In relation to three samples from $26^{th}$ to $28^{th}$ samples, the maximum outside diameter DD is 7.8 mm. In these six samples, the other parameters or configurations are common to the six samples except that they have different second bore diameter DC (that is, the third ratio R3). The second bore diameters DC and the third ratios R3 of the six samples are as follows. The second bore diameters DC of the $23^{rd}$, $24^{th}$ and $25^{th}$ samples are 3.16, 3.56, and 3.63 (mm). The third ratios R3 of the $23^{rd}$, $24^{th}$ and $25^{th}$ samples are 0.40, 0.45 and 0.46 (mm). The second bore diameters DC of the $26^{th}$, $27^{th}$ and $28^{th}$ samples are 3.12, 3.51 and 3.59 (mm). The third ratios R3 of the $26^{th}$, $27^{th}$ and $28^{th}$ samples are 0.40, 0.45 and 0.46 (mm).

In the event that the maximum outside diameter DD is great (here, 7.9 mm: the $23^{rd}$ to $25^{th}$ samples), the best evaluation point of the loaded life properties is 3 points. In the event that the maximum outside diameter DD is small (here, 7.8 mm: the $26^{th}$ to $28^{th}$ samples), the best evaluation point of the loaded life properties is 5 points (the $26^{th}$ sample). In this way, the reason that the best evaluation point is higher for the sample of the small maximum outside diameter DD than for the sample of the large maximum outside diameter DD is estimated as follows. Since the second bore diameter DC is smaller than the maximum outside diameter DD, the second bore diameter DC tends to be smaller as the maximum outside diameter DD becomes smaller. In the event that the second bore diameter DC is small, the difference between the first bore diameter DA and the second bore diameter DC is suppressed from being increased or the difference in level at the middle portion 18*b* is suppressed from being increased. Consequently, a smooth insertion can be realized in inserting the leg portion 43 of the metallic terminal 40 into the through hole 12. As a result, the materials for the members 60, 70, 80 can be compressed appropriately, and therefore, it is assumed that the loaded life properties are enhanced.

In addition, as shown by the $3^{rd}$, $5^{th}$, $6^{th}$, $16^{th}$, $25^{th}$ and $28^{th}$ samples in Table 1, with the third ratio R3 being 0.46 or greater, the loaded life properties of all the samples excluding the $3^{rd}$ one are 5 points or smaller. On the other hand, as shown by the $1^{st}$, $4^{th}$, $7^{th}$ to $15^{th}$, $17^{th}$, $20^{th}$ to $22^{nd}$, $29^{th}$ and $30^{th}$ samples in Table 1, with the third ratio R3 being 0.45 or smaller, many samples of those samples raised above can realize the loaded life properties of 10 points. In this way, the reason that the loaded life properties are better for the samples having the smaller third ratios R3 than for the samples having the greater third ratios R3 is assumed as follows. In the event that the third ratio R3 is small, there is a tendency that the second bore diameter DC also becomes small. In the event that the second bore diameter DC is small, the difference between the first bore diameter DA and the second bore diameter DC is restricted from being increased. In this way, in the event that the third ratio R3 is small, a ratio in diameter difference of the middle portion 18*b* (FIG. 2) to the maximum outside diameter DD is restricted from being increased. Consequently, a smooth insertion can be realized in inserting the leg portion 43 of the metallic terminal 40 into the through hole 12. As a result, the materials for the members 60, 70, 80 can be compressed appropriately, and therefore, it is assumed that the loaded life properties are enhanced.

In addition, as shown by the $1^{st}$, $4^{th}$, $7^{th}$ to $10^{th}$, $12^{th}$, $13^{th}$, $17^{th}$, $20^{th}$, $21^{st}$, $29^{th}$, $30^{th}$ and the like in Table 1, when applying the maximum outside diameter DD of 7.8 mm or smaller and the third ratio R3 of 0.45 or smaller to the samples having the parameters V, R1, R2 which fall in the preferable ranges (in particular, the maximum ranges), too, the loaded life properties of 5 points or greater can be realized. In this way, a value equal to or smaller than 7.8 mm may be adopted as the maximum outside diameter DD, and a value equal to or smaller than 0.45 may be adopted as the third ratio R3.

The maximum outside diameter DD equal to or smaller than 7.8 mm which can realize the loaded life properties of 5 points or greater with the parameters V, R1, R2 falling in the preferable ranges (in particular, the maximum ranges) are 6.7 mm (the $3^{rd}$ sample), 6.9 mm (the $4^{th}$ sample), 7.5 mm (the $1^{st}$ sample and the like), and 7.8 mm (the $26^{th}$ sample). One value selected arbitrarily from these values can be adopted as a lower limit of a preferable range (equal to or greater than the lower limit, and equal to or smaller than an upper limit) of the maximum outside diameter DD. For example, a value equal to or greater than 6.7 mm may be adopted as the maximum outside diameter DD. It is assumed that a smaller value (for example, 6.0 mm) can be adopted as the lower limit of the maximum outside diameter DD. In case a maximum outside diameter DD of 6.0 mm or greater is adopted, it is assumed that an appropriate spark plug can be fabricated.

The third ratio R3 equal to or smaller than 0.45 which can realize the loaded life properties of 5 points or greater with the parameters V, R1, R2 falling in the preferable ranges (in particular, the maximum ranges) are 0.37 (the $10^{th}$ sample), 0.38 (the $9^{th}$ sample), 0.40 (the $26^{th}$ sample and the like), 0.41 (the $8^{th}$ sample and the like), 0.44 (the $17^{th}$ sample) and 0.45 (the $7^{th}$ sample and the like). One value selected arbitrarily from these values can be adopted as a lower limit of a preferable range (equal to or greater than the lower limit, and equal to or smaller than an upper limit) of the third ratio R3. For example, a value equal to or greater than 0.37 may be adopted as the third ratio R3. It is assumed that a smaller value (for example, 0.35) can be adopted as the lower limit of the third ratio R3. In case a third ratio R3 of 0.35 or greater is adopted, it is assumed that an appropriate spark plug can be fabricated.

The maximum outside diameter DD may be out of the preferable range described above. For example, the maximum outside diameter DD may exceed 7.8 mm. Additionally, the third ratio R3 may be out of the preferable range described above. For example, the third ratio R3 may exceed 0.45. In either of the cases, with the parameters V, R1, R2 staying in the preferable ranges thereof, it is assumed that good loaded life properties (for example, loaded life properties of 5 points or greater), and failures of the front portion of the insulator and failures of the rear end portion of the insulator both with good evaluation points (for example, 5 points or greater) can be realized.

B6. As to Fourth Ratio R4 (SF/SE)

The $29^{th}$ and $30^{th}$ samples have different fourth ratios R4 (SF/SE). The fourth ratio R4 was adjusted by adjusting the outside diameter of the collar portion 45 of the metallic terminal 40. The second area SF is reduced by reducing the outside diameter of the collar portion 45. As a result, the fourth ratio R4 is reduced. The other configurations are common to the two samples.

As shown in Table 1, in the event that the fourth ratio R4 is small (here, 0.64: the $30^{th}$ sample), the evaluation point of the failure of the rear end portion of the insulator is 5 points. On the other hand, in the event that the fourth ratio R4 is great (here, 0.65: the $29^{th}$ sample), the evaluation point of the failure of the rear end portion of the insulator is 6 points. In this way, the failure of the rear end portion of the insulator can be better suppressed from failing in the sample with the great fourth ratio R4 than in the sample with the small fourth ratio R4. The reason is assumed as follows. When the leg portion 43 of the metallic terminal 40 is inserted in the through hole 12 in the insulator 10, the surface 45*f* of the collar portion 45 which is on the front end side in the front end direction Df is in contact with the rear end face 10*r* of the insulator 10. The rear end face 10*r* of the insulator 10 bears the force applied thereto from the metallic terminal 40 through the collar portion 45. The force that is to be borne by the rear end face 10*r* could be divided within a contact plane between the rear end face 10*r* and the surface 45*f* of the metallic terminal 40. Here, a large fourth ratio R4 indicates that a ratio of the portion of the rear end face 10*r* which can be in contact with the surface 45*f* of the metallic terminal 40 to the remaining portion thereof is great. Consequently, in the event that the fourth ratio R4 is great, the ratio of the portion of the insulator 10 which could bear the force from the surface 45*f* of the rear end face 10*r* becomes great, and therefore, the force can be divided appropriately on the rear end face 10*r*. As a result, a crack and the like can be suppressed from being generated near the rear end face 10*r* of the insulator 10. Namely, it is possible to increase the evaluation point of the failure of the rear end portion of the insulator.

The fourth ratios R4 which can realize the failure of the rear end portion of the insulator with the evaluation point of 6 points or greater are 0.65 (the $29^{th}$ sample) and 0.67 (the 1st sample and the like). One value selected arbitrarily from these values can be adopted as a lower limit of a preferable range (equal to or greater than the lower limit, and equal to or smaller than an upper limit) of the fourth ratio R4. For example, a value equal to or greater than 0.65 may be adopted as the fourth ratio R4. Of these values, an arbitrary value equal to or greater than the lower limit may be adopted as the upper limit. For example, a value equal to or smaller than 0.67 may be adopted as the fourth ratio R4. In general, when the metallic terminal 40 is inserted, the area of the contact surface between the rear end face 10*r* of the insulator 10 and the surface 45*f* of the metallic terminal 40 can be increased more as the fourth ratio R4 increases higher, and therefore, the pressure borne by the rear end face 10*r* of the insulator 10 can be reduced. Consequently, a larger value can be adopted as the fourth ratio R4. Thus, it is assumed that various values equal to or smaller than 1.0, for example, can be adopted. However, the fourth ratio R4 may be smaller than 0.65.

The evaluation point of the failure of the front end portion of the insulator for the $29^{th}$ sample is 10 points, and the evaluation point of the failure of the front end portion of the insulator for the $30^{th}$ sample is 8 points. In this way, it is possible to increase the evaluation point of the failure of the front end portion of the insulator by increasing the fourth ratio R4.

C. Modified Examples (1) Other various configurations can be adopted as the configuration of the roughened surface portion 42 of the metallic terminal 40 in place of forming the roughened surface portion 42 through knurling. For example, a configuration may be adopted in which a spiral projecting portion like a thread is formed. In general, a configuration can be adopted in which at least one of one or more projecting portions and one or more recess portions are formed on an outer circumferential surface of the portion of the metallic terminal 40 where a roughened surface portion 42 is to be formed. By adopting this configuration, the contact area between the roughened surface portion 42 and the second seal portion 80 is increased, and therefore, the joining of the metallic terminal 40 with the second seal portion 80 can be strengthened. Additionally, the mechanical strength of the roughened surface portion 42 can be strengthened. As one or more projecting portions on the outer circumferential surface, one continuous projecting portion like a thread may be adopted. In place of this, a configuration may be adopted in which a plurality of projecting portions which are separated from one another like a plurality of projecting portions formed through knurling are formed. Additionally, as one or more recess portions on the outer circumferential surface, one continuous recess portion like a thread may be adopted. In place of this, a plurality of recess portions which are separated from one another may be adopted.

(2) As the material for the resistor element 70, other various materials can be adopted in place of the material described above. For example, as to the kind of glass to be contained, a different type of glass from the one described above may be adopted. As to the conductive material, a metallic material such as copper may be adopted.

(3) As the materials for the seal portions 60, 80, other various materials can be adopted in place of those described above. For example, a kind of glass particles which is different from the kind of glass particles which is contained in the material for the resistor element 70 may be adopted. As the conductive material, carbon particles may be adopted in place of the metallic material. A material for the first seal portion 60 and a material for the second seal portion 80 may be different at least partially from each other.

(4) As the connecting portion which connects electrically the center electrode 20 to the metallic terminal 40 in the through hole 12 in the insulator 10, in place of the configuration described above which includes the members 60, 70, 80, other various configurations can be adopted. For example, the resistor element 70 may be omitted. As this occurs, one seal portion which connects electrically the metallic terminal 40 to the center electrode 20 can be adopted as a connecting portion.

(5) As the configuration of the spark plug, in place of the configuration described above, other various configurations can be adopted. For example, the whole of the center electrode 20 may be disposed in the through hole 12. Additionally, the first tip 200 of the center electrode 20 may be omitted. As the shape of the center electrode 20, various shapes which are different from the shape illustrated in FIG. 1 may be adopted. Additionally, the second tip 300 of the ground electrode 30 may be adopted. As the shape of the ground electrode 30, various shapes which are different from the shape illustrated in FIG. 1 can be adopted.

Thus, while the invention has been described based on the embodiment and the modified examples thereof, the embodiment of the invention is intended to ease the understanding of the invention and is not intended to limit the invention. The invention can be modified and improved without departing from the spirit and scope of the invention, and the resulting equivalents are understood to be included in the invention.

DESCRIPTION OF REFERENCE NUMERALS AND CHARACTERS

5 gasket;
6 first rear end side packing;
7 second rear end packing;
8 front end side packing;
9 talc;
10 insulator (ceramic insulator);
10*r* rear end face;
11 second reduced outside diameter portion;
12 through hole (axial hole);
13 nose portion;
14 opening;
15 first reduced outside portion;
16 first reduced bore diameter portion;
17 front end side body portion;
18 rear end side body portion;
18*a* first portion;
18*b* middle portion;
18*c* second portion;
18*d* rear end side portion;
19 collar portion;
20 electrode;
20 center electrode;
21 outer layer;
22 core portion;
23 head portion;
24 collar portion;
25 nose portion;
27 shaft portion;
30 ground electrode;
31 distal end portion;
35 outer layer;

36 core portion;
37 shaft portion;
40 metallic terminal;
41 front end;
42 roughened surface portion;
43 leg portion;
44 portion;
45 collar portion;
45*f* surface;
47 collar portion;
48 mounting portion;
50 metal shell;
51 tool engagement portion;
52 thread;
53 crimping portion;
54 seat portion;
55 body portion;
56 reduced bore diameter portion;
57 front end face;
58 deformable portion;
59 through hole;
60 first seal portion;
70 resistor element;
80 second seal portion;
100 spark plug;
200 first tip;
300 second tip;
g gap;
CL center line (axis);
Df front end direction;
Dfr rear end direction.

Having described the invention, the following is claimed:

1. A spark plug, comprising:

a rod-shaped center electrode that extends in a direction of an axis;

an insulator through which a through hole extends from a front end side of the insulator to a rear end side of the insulator in the direction of the axis, where at least a portion of the center electrode is disposed in a front end side of the through hole;

a metallic terminal at least a portion of which is disposed in a rear end side of the through hole, a rear end side portion of the metallic terminal being exposed out of the through hole; and a connecting portion that electrically connects the center electrode to the metallic terminal in the through hole, wherein the insulator comprises:

a first portion that accommodates a front end of the metallic terminal and has a first bore diameter that is less than or equal to 2.9 mm;

a second portion that is disposed closer to the rear end side of the insulator than the first portion and has a second bore diameter that is greater than the first bore diameter; and a middle portion that is disposed between the first portion and the second portion and has a bore diameter that increases towards the rear end side of the insulator, wherein the metallic terminal includes a roughened surface portion extending from a position inside the first portion to a position inside the second portion through the middle portion in the direction of the axis, the roughened surface portion having at least one of one or more projecting portions and one or more recess portions on an outer circumferential surface thereof, wherein a Vickers hardness of a portion of the metallic terminal disposed in the through hole closer to the rear end side of the through hole than the roughened surface portion is in a range of 200 Hv to 320 Hv, wherein a first ratio, which is a ratio of an outside diameter of a part of the roughened surface portion that is accommodated in the first portion to the first bore diameter, is greater than or equal to 0.90, wherein a second ratio, which is a ratio of the first bore diameter to the second bore, is in a range of 0.80 and 0.98, wherein at least a portion of a front end surface of the exposed portion of the metallic terminal is in contact with a rear end face of the insulator, and wherein, when the rear end face of the insulator and the front end surface of the exposed portion of the metallic terminal are projected along the direction of the axis on to aplane that is at right angles to the axis, a ratio of a projection area of the front end surface of the exposed portion of the metallic terminal to a projection area of the rear end face of the insulator is greater than or equal to 0.65.

2. The spark plug according to claim 1, wherein the second ratio is in a range of 0.80 to 0.96.

3. The spark plug according to claim 1, wherein a maximum outside diameter of the second portion of the insulator is less than or equal to 7.8 mm, and wherein a ratio of the second bore diameter of the second portion to the maximum outside diameter of the second portion is less than or equal to 0.45.

4. The spark plug according to claim 2, wherein a maximum outside diameter of the second portion of the insulator is less than or equal to 7.8 mm, and wherein a ratio of the second bore diameter of the second portion to the maximum outside diameter of the second portion is less than or equal to 0.45.

* * * * *